US011684091B2

(12) United States Patent
Calamia

(10) Patent No.: US 11,684,091 B2
(45) Date of Patent: Jun. 27, 2023

(54) UNDERWEAR WITH FOLDED DIAGONAL FLY

(71) Applicant: Bombas LLC, New York, NY (US)

(72) Inventor: Melissa Calamia, Brooklyn, NY (US)

(73) Assignee: Bombas LLC, New York, NY (US)

( * ) Notice: Subject to any disclaimer, the term of this patent is extended or adjusted under 35 U.S.C. 154(b) by 242 days.

(21) Appl. No.: 17/020,939

(22) Filed: Sep. 15, 2020

(65) Prior Publication Data

US 2022/0079251 A1 Mar. 17, 2022

(51) Int. Cl.
*A41B 9/02* (2006.01)
*A41B 9/14* (2006.01)

(52) U.S. Cl.
CPC ..... *A41B 9/026* (2013.01); *A41B 9/02* (2013.01); *A41B 9/14* (2013.01)

(58) Field of Classification Search
CPC ..... A41B 9/026; A41B 9/02; A41B 9/14
See application file for complete search history.

(56) References Cited

U.S. PATENT DOCUMENTS 2,138,481 A * 11/1938 Chatfield ..... A41B 9/02 602/69
2,140,459 A * 12/1938 Reis ..... A41B 9/02 602/67
2,214,578 A * 9/1940 Davis ..... A41B 9/02 2/403
2,235,848 A * 3/1941 Reis ..... A41B 9/02 2/234
2,258,411 A * 10/1941 Fiagg ..... A41B 9/02 2/403
2,438,310 A * 3/1948 Ashe ..... A41B 9/02 2/403
2,570,498 A * 10/1951 Senderowitz ..... A41B 9/02 2/403
2,601,602 A * 6/1952 Firsching, Sr. ..... A41B 9/023 602/67

(Continued)

FOREIGN PATENT DOCUMENTS

JP 58155302 U 10/1983
KR 101728340 B1 4/2017
WO 9839981 A1 9/1998

OTHER PUBLICATIONS

Stance, Inc., "Standard 6in Boxer Brief", Boxer Brief Underwear $24.99, 2020, https://www.stance.com/standard-6in-boxer-brief/M802A20ST6.html, Retrieved on Sep. 14, 2020.

(Continued)

*Primary Examiner* — Khaled Annis
(74) *Attorney, Agent, or Firm* — Barnes and Thornburg LLP; Tina M. Dorr

(57) ABSTRACT

An underwear includes a front body portion and a rear body portion. The underwear includes a waistband attached to edges of the front body portion and the rear body portion. The underwear further includes an interior pouch panel. The underwear also includes an exterior pouch panel overlaying the interior pouch panel and attached to the front body portion. The exterior pouch panel includes a folded edge arranged at an oblique angle with respect to the waistband that provides an opening into an interior of the underwear.

14 Claims, 7 Drawing Sheets

(56) References Cited

U.S. PATENT DOCUMENTS

| | | | | |
|---|---|---|---|---|
| 3,038,471 | A * | 6/1962 | Van Horne | A41B 9/02 602/67 |
| 3,166,764 | A * | 1/1965 | Stedman | A41B 9/02 2/403 |
| 5,461,729 | A * | 10/1995 | Brocks | A41B 9/02 2/401 |
| 5,870,779 | A * | 2/1999 | Heron | A41B 9/023 2/403 |
| 6,557,183 | B1 * | 5/2003 | Truong | A41B 9/02 2/403 |
| D553,826 | S | 10/2007 | Austin | |
| 7,676,853 | B1 * | 3/2010 | Cutlip | A41B 9/023 2/403 |
| 7,958,571 | B2 | 6/2011 | Kitsch et al. | |
| D722,742 | S | 2/2015 | Abrams | |
| D735,444 | S | 8/2015 | Harris | |
| D756,069 | S | 5/2016 | Astin | |
| D761,520 | S | 7/2016 | Klein | |
| D798,530 | S | 10/2017 | Cook | |
| D846,833 | S | 4/2019 | Cai | |
| D848,110 | S | 5/2019 | Harris | |
| D850,059 | S | 6/2019 | Cai | |
| D862,839 | S | 10/2019 | Ji | |
| 10,638,797 | B2 * | 5/2020 | Ellingson | A41B 9/023 |
| D908,316 | S | 1/2021 | Berger et al. | |
| D917,127 | S | 4/2021 | Chisholm et al. | |
| 10,986,877 | B2 | 4/2021 | Kimel et al. | |
| 2006/0000008 | A1 * | 1/2006 | Chong | A41B 9/023 2/403 |
| 2012/0167279 | A1 * | 7/2012 | Bigney | A41B 9/02 2/401 |
| 2016/0278438 | A1 * | 9/2016 | Polidan | A41B 9/023 |
| 2019/0116889 | A1 * | 4/2019 | Kimel | A41B 9/026 |
| 2019/0254353 | A1 * | 8/2019 | Patton | A41B 9/026 |
| 2021/0337883 | A1 * | 11/2021 | Patmore | A41B 9/023 |

OTHER PUBLICATIONS

Bombas Facebook photo, [online]; [photo published to the internet on Jan. 12, 2021]; [retrieved from the internet on Nov. 18, 2021]; URL: https://www.facebook.com/bombassocks/photos/a.458944910853875/3632197013528633/?type=3. (1 page). (Year: 2021).

Notification of Transmittal of the International Search Report and the Written Opinion of the International Searching Authority PCT/US2021/050002, dated Dec. 22, 2021 (15 pages).

Men's Cotton Modal Boxer Brief, [online]; [review published to the internet on Jan. 28, 2021]; [retrieved from the internet on Nov. 18, 2021]; URL: https://bombas.com/products/mens-cotton-modal-boxer-brief-underwear?variant=navy-fair-isle&size=I. (7pages). (Year: 2021).

* cited by examiner

UNDERWEAR WITH FOLDED DIAGONAL FLY

BACKGROUND

The present disclosure relates to underwear, and more particularly, to underwear with a folded diagonal fly.

Various forms of male underwear have been developed. Examples of types of male undergarments include briefs, boxer briefs, trunks, and loosely fitting shorts known as boxers.

Men's briefs and boxer briefs are generally constructed with one or more trunk or body panels, and overlapping front panels. The overlapping front panels typically define a fly opening for access through the outermost panel to the male genitalia. A man can access his genitalia either through the fly opening or from above.

SUMMARY

According to some aspects, an underwear includes a front body portion and a rear body portion. The underwear includes a waistband attached to edges of the front body portion and the rear body portion. The underwear further includes an interior pouch panel. The underwear also includes an exterior pouch panel overlaying the interior pouch panel and attached to the front body portion. The exterior pouch panel includes a folded edge arranged at an oblique angle with respect to the waistband that provides an opening into an interior of the underwear.

According to other aspects, an underwear includes a front body portion and a rear body portion. The underwear includes a waistband attached to edges of the front body portion and the rear body portion. The underwear also includes an interior pouch panel. The underwear further includes an exterior pouch panel overlaying the interior pouch panel and attached to the front body portion. The exterior pouch panel includes a first layer, a second layer, and folded edge arranged at an oblique angle with respect to the waistband that provides an opening into an interior of the underwear. The first layer and second layer are mirror images of one another.

Yet, according to other aspects, a method of making an underwear includes attaching a waistband to edges of a front body portion and a rear body portion. The method further includes attaching an exterior pouch panel to the front body portion such that the exterior pouch panel overlays an interior pouch panel. The exterior pouch panel includes a folded edge arranged at an oblique angle with respect to the waistband that provides an opening into an interior of the underwear.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
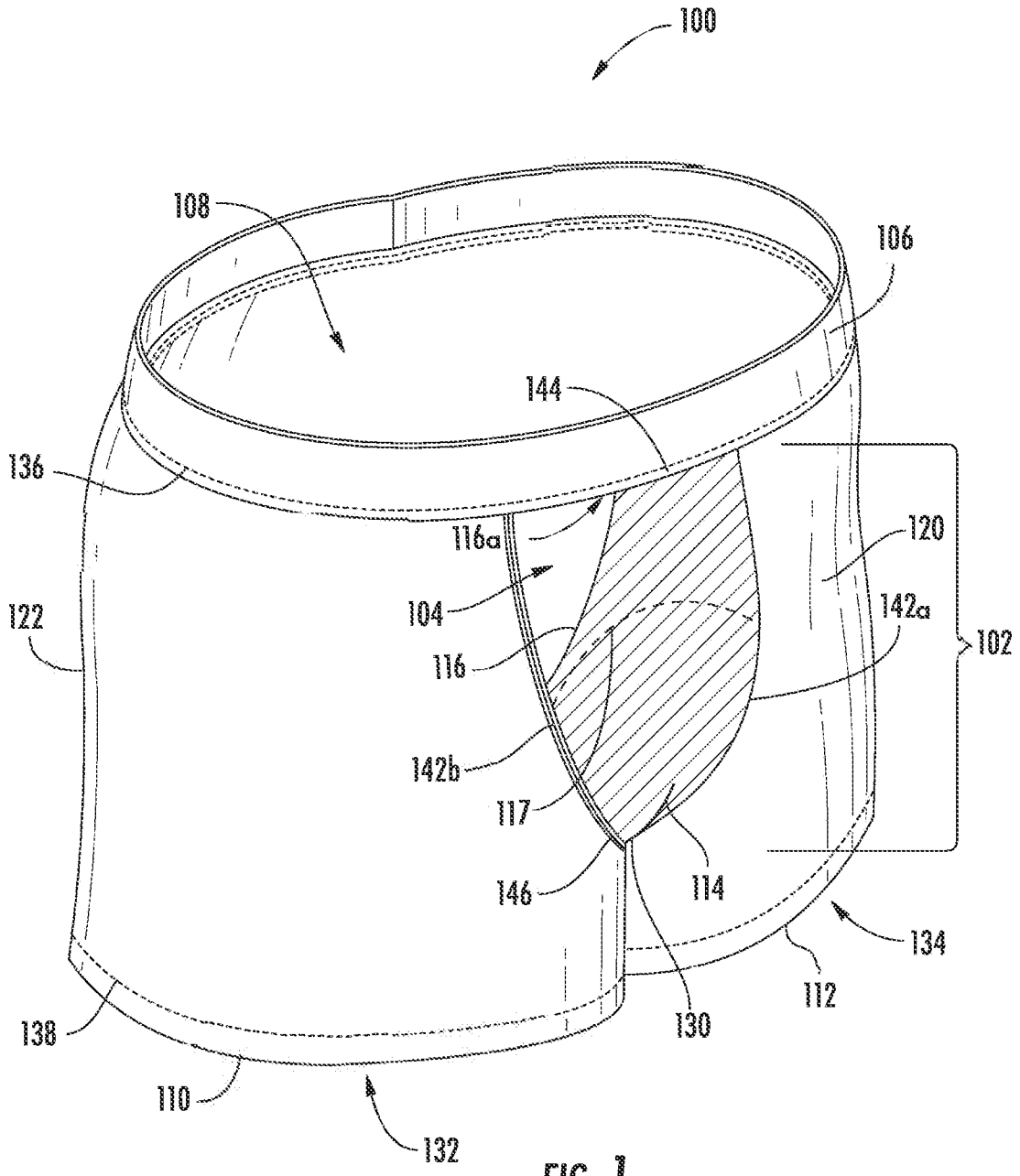
FIG. 1 is a perspective view of an underwear construction according to aspects of the present invention.

Drawbacks associated with male underwear constructions include discomfort, lack of support, and embarrassment due to unsightly bulging or slippage of the male genital organs within. To address these challenges, male undergarment construction has focused on snug-fit and fly arrangements that prevent the male genitalia from falling therethrough. To that end, pouches and sacks, cages, and girdles have been generally incorporated into briefs toward the end of an undergarment construction.

Generally, male underwear has been constructed with front fly formed by overlapping front panel. In one example, when inner and outer panels are used, each panel has a concave portion formed on one side edge, and the two panels are placed one upon the other so that the concave portion on the outer panel is on the opposite side from the concave portion of the inner front panel. This type of construction has drawbacks that include complications in accessing male genitalia and irritation from edge seams.

In order to address the above challenges, described herein are male underwear constructions and methods of making male underwear constructions with a front pouch attached to the body that is formed from a single piece of material that is folded along a diagonal "slash," with respect to the horizontal waistband. The self-folded construction reduces bulk and points of irritation, compared to constructions with other types of edge seams. The folded slash fly construction also includes a side-entry design, which allows the wearer to directly access the male genitalia, in contrast to other fly constructions that require navigation between overlapping layers.

The phrase "underwear," "undergarment," "male underwear," and "male undergarment," and variations thereof, are used in this detailed description to include male underwear or undergarments. Examples of male underwear and undergarments include, but are not limited to, briefs, bikini briefs, boxer briefs, boxers, long underwear, trunks, and shorts, e.g., exercise shorts, bike shorts, swim shorts, and the like.

FIGS. 1-5 illustrate a perspective view, front exterior view, rear view, bottom view, and front interior view, respectively, of an underwear construction according to aspects of the present invention. The underwear 100 includes a front body portion 120, a rear body portion 122, a waistband 106 attached to top edges of the front body portion 120 and rear body portion 122, a left leg portion 112 (also referred to as a first leg portion), a right leg portion 110 (also referred to as a second leg portion), a left leg opening 134, a right leg opening 132, a crotch 130, a gusset 402 (see FIG. 4), an interior pouch panel 104, and a self-lined exterior pouch 102. The underwear 100 is a boxer brief construction.

The front body portion 120 and rear body portion 122 can be formed from the same piece of material that is attached to the waistband 106. In some aspects, the front body portion 120 and the rear body portion 122 are formed of two or more pieces of material that are attached together before being attached to the waistband 106. In other aspects, the front body portion 120 and rear body portion 122 are not attached together before being attached to the waistband 106. The left leg portion 112 and right leg portion 110 form left leg opening 134 and right leg opening 132. The interior pouch panel 104 can be a continuous part of the front body portion 120, or the interior pouch panel 104 can be formed from a separate piece of material that is attached to the front body portion 120. The gusset 402 (see FIG. 4) between the left leg portion 112 and the right leg portion 110 is a strip of material between front body portion 120 and rear body portion 112.

The body of the underwear 100, including the front body portion 120, the rear body portion 122, left leg portion 110, right leg portion 112, and gusset 402 (see FIG. 4) can be formed of natural or synthetic fibers/materials. The type of material used for the body of the underwear 100 depends on the particular use. Everyday underwear can include, for example, cotton fiber and cotton fiber blends. Athletic underwear can include, for example, synthetic fiber and synthetic fiber blends. Non-limiting examples of fibers/materials for the body of the underwear include cotton fibers, synthetic fibers, such as polyester fibers, nylon fibers, or polyurethane fibers, reconstituted cellulose fibers such as rayon, modal, micromodal, tencel, blends thereof, or any combination thereof.

The waistband 106 is attached to and surrounds the upper or top portion or edges of the underwear 100 and encircles the body opening 108. In some aspects, the waistband 106 includes an elastic material. Yet, in other aspects, the waistband 106 is a non-elastic waistband, e.g., with a drawstring. Any suitable type of waistband 106 can be implemented.

Figure 3:
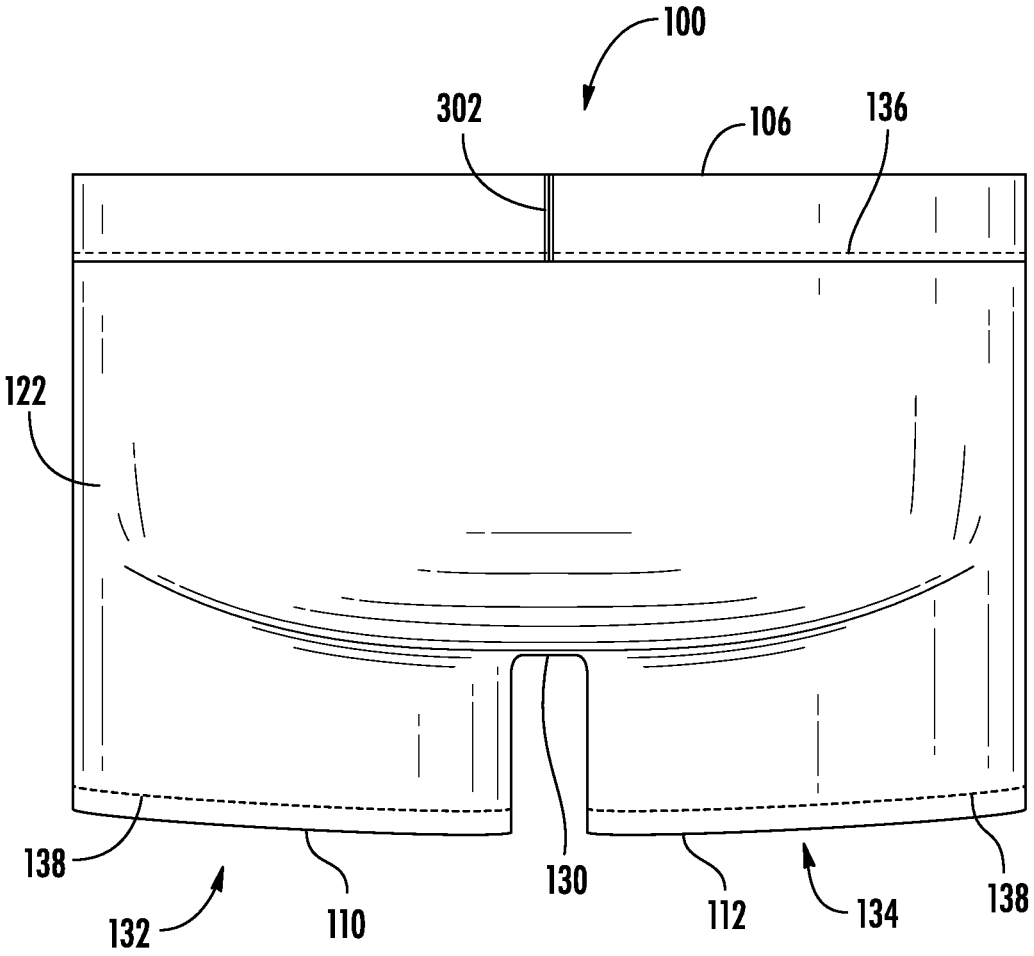
FIG. 3 is a rear view of the underwear construction of FIG. 1.
Figure 4:
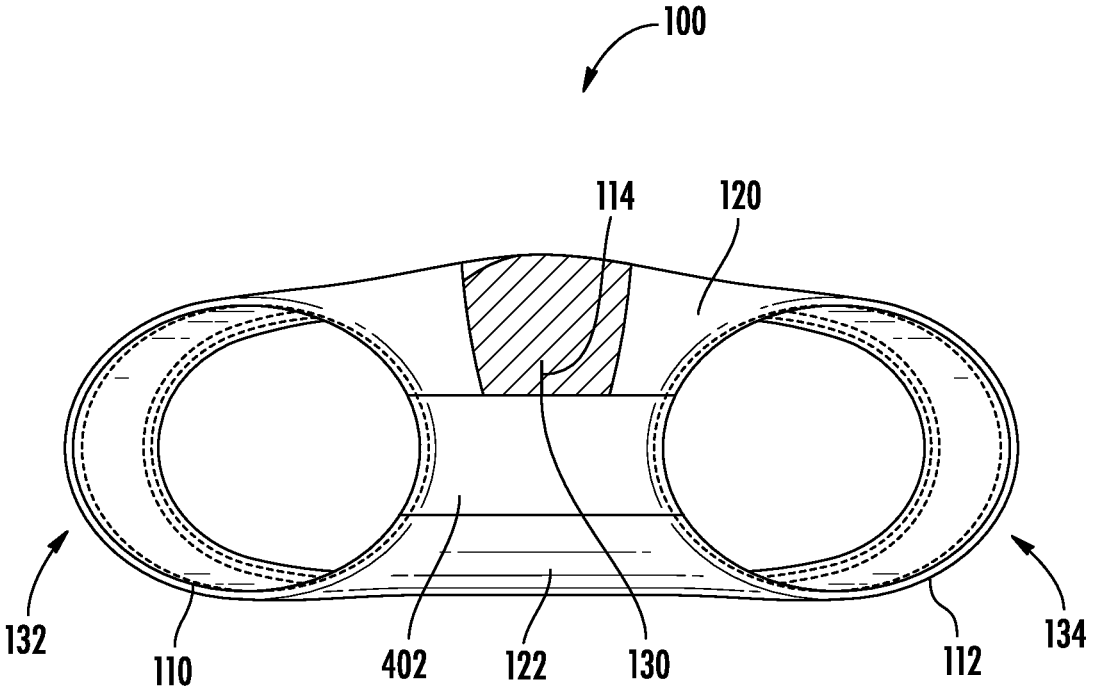
FIG. 4 is a bottom view of the underwear construction of FIG. 1.

To form the waistband 106, a linear piece of material can be joined before or after attaching to the body of the underwear 100. The waistband material can be joined to form a circular band by any suitable means, for example, by stitching to form a stitched seam 302, as shown in FIG. 3. A non-limiting example of a suitable method for stitching the waistband 106 includes using a flatlock stitch.

The waistband 106 is attached to the top/upper portion/edges of the body of the underwear 100 (front body portion 120 and rear body portion 122) by a suitable means. In some aspects, the waistband 106 is attached to the body of the underwear 100 by a stitched seam 136 through all layers of fabric that extends along the edge of the waistband 106. A non-limiting example of a stitch that can be used to form the stitched seam 136 is an overlock stitch or coverstitch.

According to some aspects, the left leg portion 112 and right leg portion 110 can be finished at the edges close to the left leg opening 134 and the right leg opening 132 by stitching to form a stitched seam 138 that surrounds each of the left leg portion 112 and right leg portion 110, for example, using a 2 needle coverstitch.

The self-lined exterior pouch 102 is formed as a separate part from the interior pouch panel 104. The self-lined exterior pouch 102 includes a top edge 144, a first side edge 142*a* (also referred to as a left side edge), a second side edge 142*b* (also referred to as a right side edge), a bottom edge 146, a folded edge 116, and a central dart 114 in the crotch 130. The self-lined exterior pouch 102 overlays the interior pouch panel 104 and is partially attached along front body portion 120. The folded edge 116 is arranged at an oblique angle 116*a* with respect to the waistband 106 to provide an opening into the interior of the underwear, so that the wearer has interior access. The oblique angle 116*a* shown for the folded edge 116 and the size of the interior pouch panel 104 are but one example of a design, and the oblique angle 116*a* with respect to the waistband 106 and the size of the interior pouch panel 104 can differ than that shown in some embodiments. Depending on the material used to form the self-lined exterior pouch 102, bonding or elastic can be used along the edge of the folded edge 116. The central dart 114 in the crotch area allows the self-lined exterior pouch 102 to be convex in shape.

Figure 6:
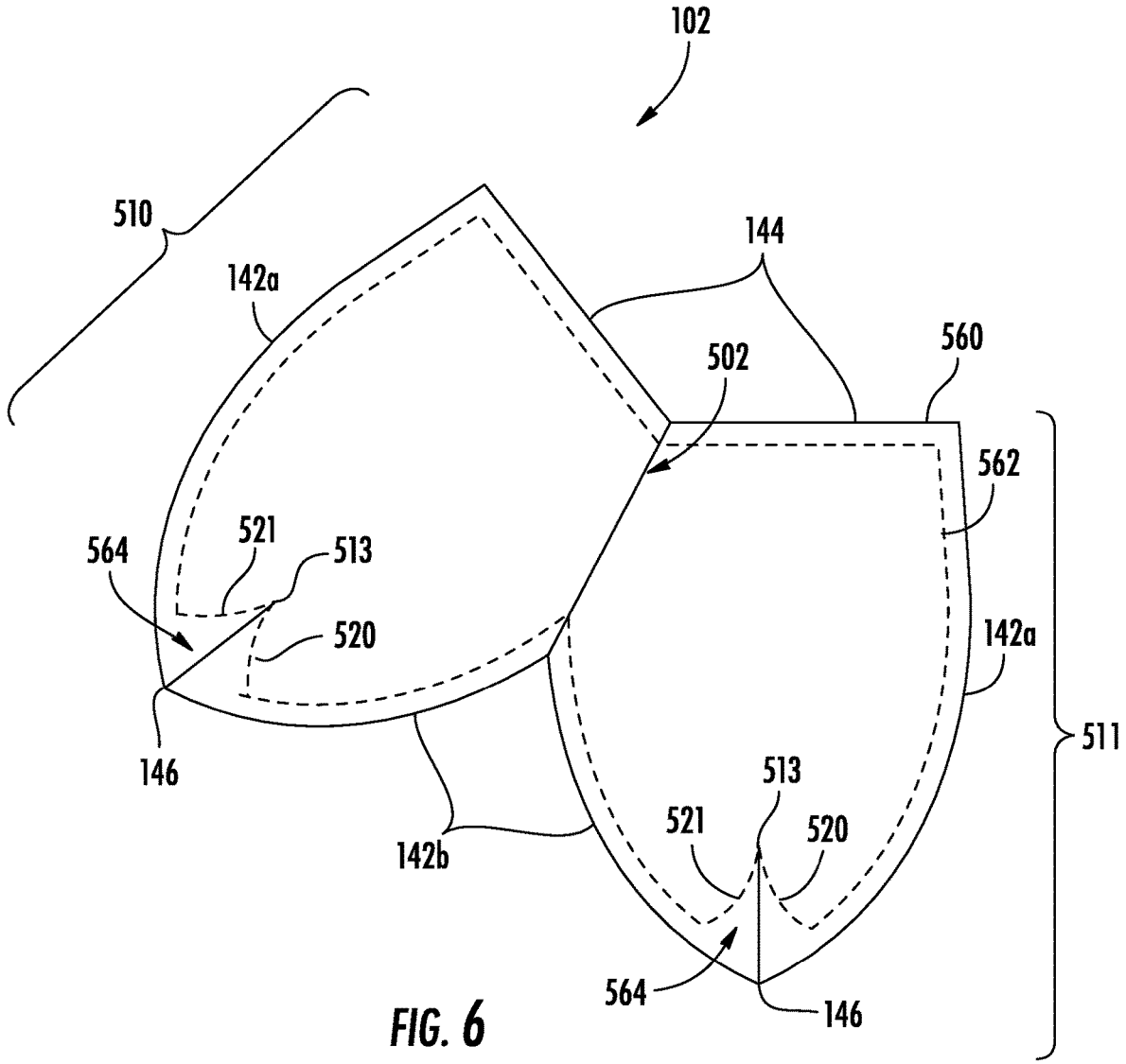
FIG. 6 is an unfolded pouch pattern for an underwear construction according to aspects of the present invention.

FIG. 6 is an unfolded self-lined exterior pouch 102, which is formed, folded, and stitched prior to attaching to the body of the underwear. The outer edge 560 is the cutting line of the pouch pattern, and the stitching line 562 that runs along the inside of the outer edge 560 shows the stitching line.

The unfolded pouch includes a first layer 510 and a second layer 511, which are mirror images of one another and folded along the central folding edge 502. The folding edge 502 between the first layer and the second layer 511 is the axis of symmetry.

Each of the first layer 510 and second layer 511 includes a straight top edge 144, and lateral side edges (first side edge 142*a* and second side edge 142*b*). The lateral side edges (first side edge 142*a* and second side edge 142*b*) centrally curve and taper towards the bottom edges 146, which will form the bottom of the crotch 130 (see FIGS. 1 and 2).

The stitching line 562 that runs along the inside border of the outer edge 560 includes a triangular indention at the bottom edge 146. The triangular indention includes a central apex 513 opposite the bottom edge 146, a first curved edge 520, and a second curved edge 521. The first curved edge 520 and the second curved edge 521 meet at the apex 513 and curve outwardly (laterally) away from the bottom edge 146.

The first layer 510 and second layer 511 each include a fold line 564 that extends from the bottom edge 146 of the outer edge 560 to the apex 513 of the triangular indention of the stitching line 562.

Figure 2:
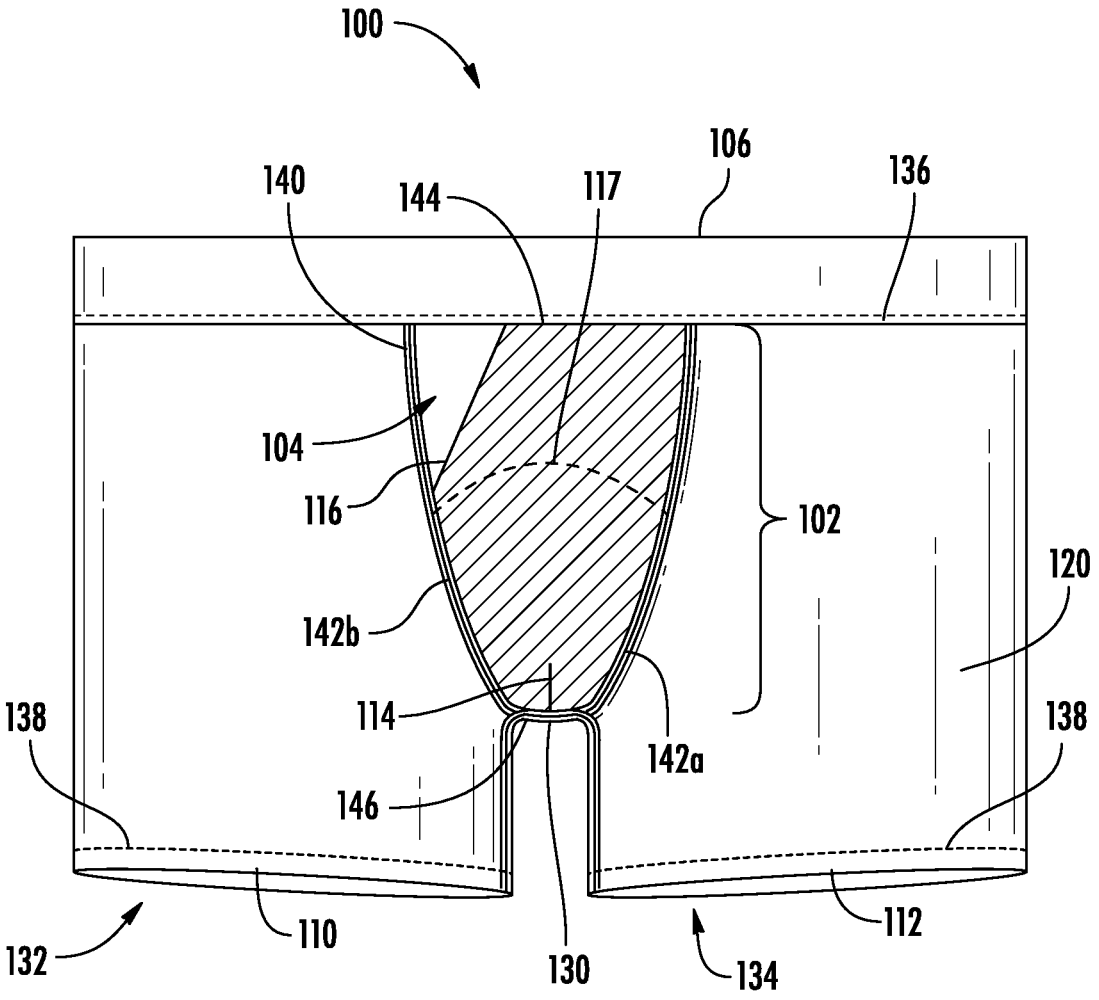
FIG. 2 is a front exterior view of the underwear construction of FIG. 1.

Prior to folding at the central folding edge 502, the pouch is folded at fold lines 564 and stitched along stitching line 562 of the triangular indention to create a convex-shaped pocket with a dart 114 in the lower crotch area of the self-lined exterior pouch 102 (see FIGS. 1 and 2). The unfolded pouch is then folded at the central folding edge 502 to fold the first layer 510 onto the second layer 511 to form folded edge 116, as shown in FIGS. 1 and 2. The folded pouch is stitched along stitching line 562. The remaining fabric outside the stitching line 562 can be trimmed away during or after sewing. Non-limiting examples of stitching that can be used along the stitching line 562 include a MERROW or an overlock stitch.

Referring again to FIGS. 1 and 2, once folded and stitched, the self-lined exterior pouch 102 is attached to the front body portion 120 of the underwear 100. The self-lined exterior pouch 102 can be attached to the front body portion 120 by stitching, for example, using an ACTIVESEAM stitch. The first side edge 142*a* is attached to the front body portion 120, by stitching to form a continuous stitched seam that extends from the waistband 106 to the bottom edge 146 at the crotch 130. The opposing side of the self-lined exterior pouch 102 is only partially attached, as the folded edge 116 overlaying the interior pouch panel 140 is not attached (left unattached) to leave an opening for the wearer to access. The second side edge 142*b* is attached to the front body portion 120 by a stitched seam that extends from the bottom/lower corner of the folded edge 116 of the self-lined external pouch 102 to the bottom edge 146 at the crotch 130. The folded edge 116 of the self-lined exterior pouch 102 is arranged at a diagonal or oblique angle with respect to the horizontal waistband 106 and is unattached to provide an opening into an interior of the underwear 100.

Figure 5:
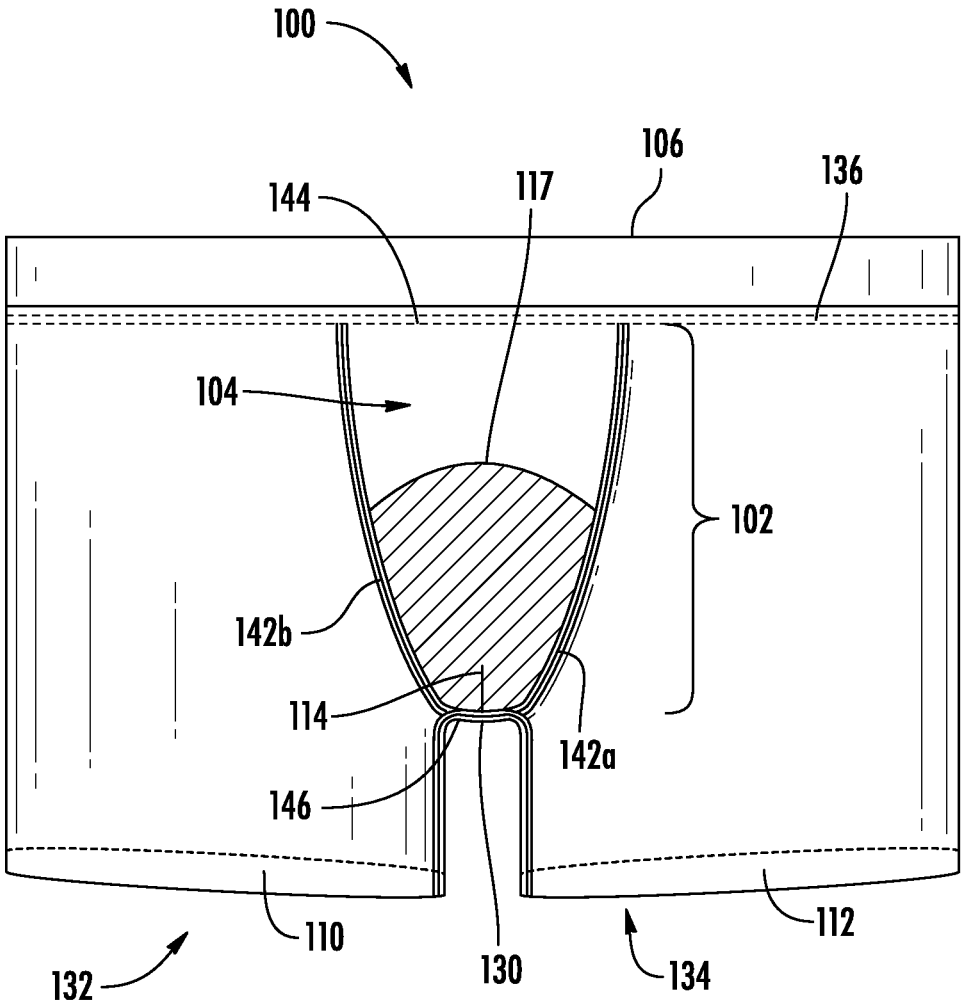
FIG. 5 is a front interior view of the underwear construction of FIG. 1.

The bottom edge 117 of the interior pouch panel 104, which is also shown in the front interior view of the underwear 100 in FIG. 5, is arranged beneath and hidden behind the self-lined exterior pouch 102. The bottom edge 117 can have a curved edge. Although, the edge can be a straight edge in some aspects. The bottom edge 117 of the interior pouch panel 104 can be finished with stitching, for example, a MERROW stitch. The self-lined exterior pouch 102 can be the same material or a different material than the interior pouch panel 104. Depending on the material used to form the interior pouch panel 104, bonding or elastic may be used along the edge of the bottom edge 117.

Referring again to FIGS. 1 and 2, the self-lined exterior pouch 102 is added to male underwear or undergarments. The self-lined exterior pouch 102 overlays the interior pouch panel 104 and allows the user to access the opening into the interior of the underwear 100 by reaching through the folded edge 116. The size, shape, and dimensions of the self-lined exterior pouch 102 can vary depending on the type of underwear construction and preference of the wearer.

Advantages of the self-lined exterior pouch 102 with the folded edge 116 that overlays the interior pouch panel 104 include increased ease of access inside the underwear 100 by the wearer through the side. Another advantage is that the self-lined exterior pouch 102 overlaying the interior pouch panel 104 does not have rough edges or seams that can potentially irritate the wearer.

Figure 7:
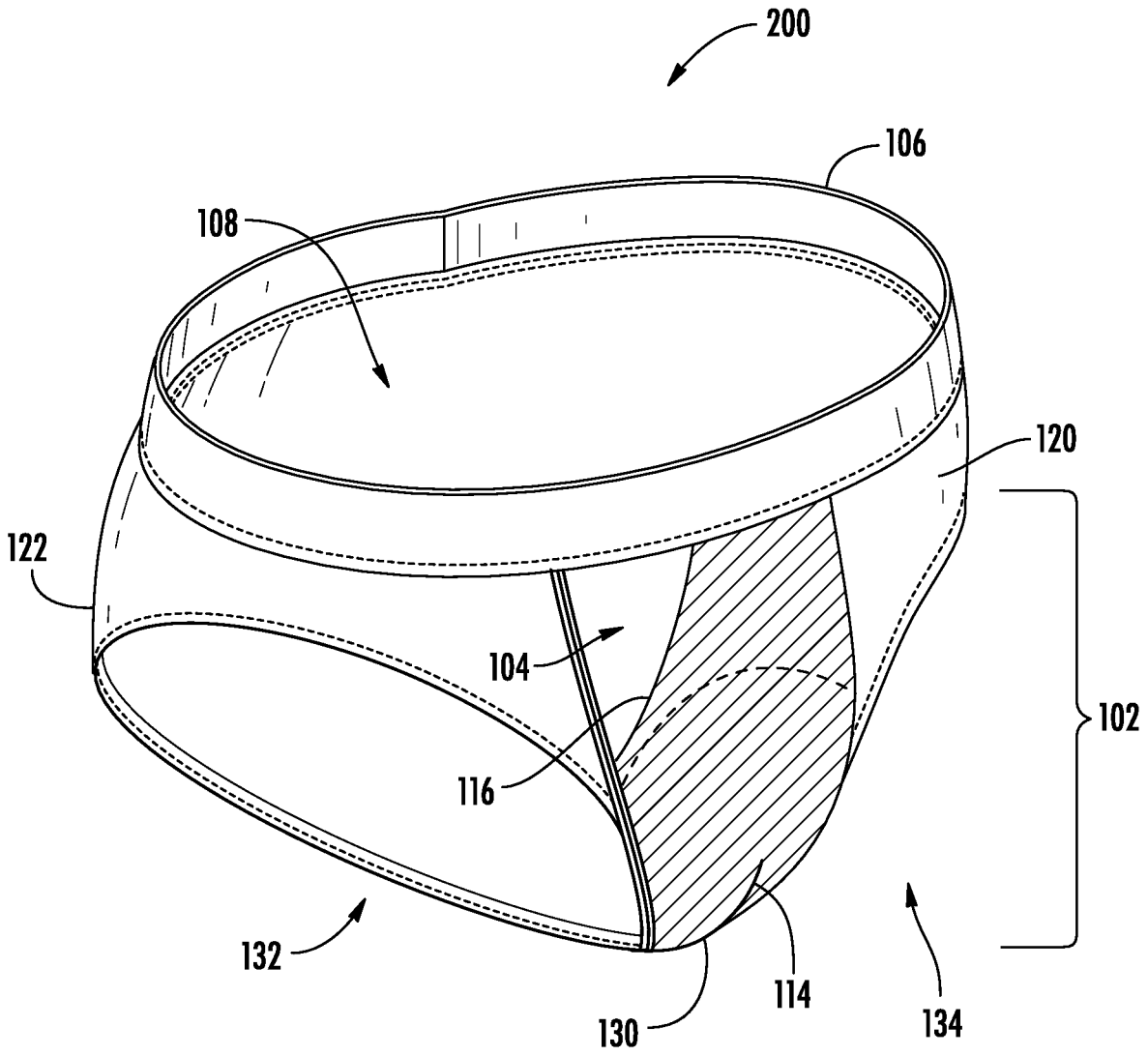
FIG. 7 is a perspective view of an underwear construction according to aspects of the present invention.

FIG. 7 is a perspective view of an underwear construction according to some aspects of the present invention. The underwear 200 includes a front body portion 120, a rear body portion 122, a waistband 106 attached to the front portion 120 and rear portions 122, a left leg opening 132, a right leg opening 134, a crotch 130, an interior pouch panel 104, and a self-lined exterior pouch 102. The underwear 200 is a brief construction. Any of the above descriptions for the self-lined exterior pouch 102 and interior pouch panel 104 of FIGS. 1-6 are applicable to the brief construction in FIG. 7.

The underwear constructions described herein can be made by patterning and forming an unfolded pouch, as shown in FIG. 6. The patterned unfolded pouch is folded at the folding edge 502 to fold the first layer 510 onto the second layer 511 to form folded edge 116, as shown in FIGS. 1 and 2. The pouch is also folded at fold lines 564 and stitched to create a convex-shaped pocket in the lower crotch area of the self-lined exterior pouch 102. Referring again to FIGS. 1 and 2, once folded and stitched, the self-lined exterior pouch 102 is attached to the front body portion 120 of the underwear, as described above.

Various embodiments of the present invention are described herein with reference to the related drawings. Alternative embodiments can be devised without departing from the scope of this invention. Although various connections and positional relationships (e.g., over, below, adjacent, etc.) are set forth between elements in the following description and in the drawings, persons skilled in the art will recognize that many of the positional relationships described herein are orientation-independent when the described functionality is maintained even though the orientation is changed. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. As an example of an indirect positional relationship, references in the present description to forming layer "A" over layer "B" include situations in which one or more intermediate layers (e.g., layer "C") is between layer "A" and layer "B" as long as the relevant characteristics and functionalities of layer "A" and layer "B" are not substantially changed by the intermediate layer(s).

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection."

References in the specification to "one embodiment," "an embodiment," "an example embodiment," etc., indicate that the embodiment described can include a particular feature, structure, or characteristic, but every embodiment may or may not include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

For purposes of the description hereinafter, the terms "upper," "lower," "right," "left," "vertical," "horizontal," "top," "bottom," and derivatives thereof shall relate to the described structures and methods, as oriented in the drawing figures. The terms "overlying," "atop," "on top," "positioned on" or "positioned atop" mean that a first element, such as a first structure, is present on a second element, such as a second structure, wherein intervening elements such as an interface structure can be present between the first element and the second element. The term "direct contact" means that a first element, such as a first structure, and a second element, such as a second structure, are connected without any intermediary conducting, insulating or semiconductor layers at the interface of the two elements.

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While the preferred embodiments to the invention have been described, it will be understood that those skilled in the art, both now and in the future, may make various improvements and enhancements which fall within the scope of the claims which follow. These claims should be construed to maintain the proper protection for the invention first described.

What is claimed is:

1. An underwear, comprising:

a front body portion and a rear body portion;

a waistband attached to edges of the front body portion and the rear body portion;

an interior pouch panel; and an exterior pouch panel overlaying the interior pouch panel and attached to the front body portion, the exterior pouch panel comprising a folded edge that forms an oblique angle between the waistband and the folded edge, and the folded edge extends from a lateral side to a top edge of the exterior pouch panel and provides an opening into an interior of the underwear;

wherein the exterior pouch panel is formed from a single piece of material that is folded to form the folded edge.

2. The underwear of claim 1, wherein the underwear is a brief, a bikini brief, a boxer brief, a boxer, a long underwear, a short, a trunk, or any combination thereof.

3. The underwear of claim 2, wherein the underwear is the boxer brief.

4. The underwear of claim 2, wherein the underwear is the brief.

5. The underwear of claim 1, wherein the exterior pouch panel further comprises a central dart at a crotch area and a convex shape.

6. The underwear of claim 1, wherein the exterior pouch panel comprises two layers that are mirror images of one another, and an axis of symmetry is at the folded edge.

7. An underwear, comprising:

a front body portion and a rear body portion;

a waistband attached to edges of the front body portion and the rear body portion;

an interior pouch panel; and an exterior pouch panel overlaying the interior pouch panel and attached to the front body portion, the exterior pouch panel comprising a first layer, a second layer, and a folded edge that forms an oblique angle between the waistband and the folded edge, and the folded edge extends from a lateral side edge to a top edge of the exterior pouch panel and provides an opening into an interior of the underwear, the first layer and second layer being mirror images of one another;

wherein the exterior pouch panel is formed from a single piece of material that is folded to form the folded edge.

8. The underwear of claim 7, wherein an axis of symmetry of the first layer and second layer is at the folded edge.

9. The underwear of claim 8, wherein the folded edge is not attached to the interior pouch panel.

10. The underwear of claim 7, wherein the underwear is a brief, a bikini brief, a boxer brief, a boxer, a long underwear, a short, a trunk, or any combination thereof.

11. The underwear of claim 10, wherein the underwear is the boxer brief.

12. The underwear of claim 10, wherein the underwear is the brief.

13. The underwear of claim 7, wherein the exterior pouch panel further comprises a central dart at a crotch area.

14. The underwear of claim 7, wherein the exterior pouch panel comprises a convex shape.

* * * * *